US006677284B2

(12) United States Patent
Rajewski et al.

(10) Patent No.: US 6,677,284 B2
(45) Date of Patent: Jan. 13, 2004

(54) LUBRICANT COMPOSITION FOR AMMONIA BASED REFRIGERANTS WITH GOOD SEAL PERFORMANCE

(75) Inventors: Thomas Rajewski, Auburn, MI (US); John C. Tolfa, Midland, MI (US); Hsinheng Li, Mt. Pleasant, MI (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/220,460

(22) PCT Filed: Mar. 15, 2001

(86) PCT No.: PCT/US01/08381

§ 371 (c)(1),
(2), (4) Date: Aug. 29, 2002

(87) PCT Pub. No.: WO01/68791

PCT Pub. Date: Sep. 20, 2001

(65) Prior Publication Data

US 2003/0104951 A1 Jun. 5, 2003

(51) Int. Cl.[7] ..... C10M 145/36; C10M 169/04
(52) U.S. Cl. ..... 508/579; 252/68
(58) Field of Search ..... 508/579; 252/68

(56) References Cited

U.S. PATENT DOCUMENTS

| | | | | |
|---|---|---|---|---|
| 4,851,144 A | | 7/1989 | McGraw et al. | 252/52 A |
| 5,372,737 A | | 12/1994 | Spauschus | 252/68 |
| 5,413,728 A | | 5/1995 | Mall et al. | 252/68 |
| 5,595,678 A | | 1/1997 | Short et al. | 252/68 |
| 5,688,433 A | * | 11/1997 | Kasahara et al. | 252/68 |
| 6,074,573 A | * | 6/2000 | Kaneko | 252/68 |
| 6,193,906 B1 | * | 2/2001 | Kaneko et al. | 252/68 |
| 6,239,086 B1 | * | 5/2001 | Hirano et al. | 508/579 |
| 6,322,719 B2 | * | 11/2001 | Kaneko et al. | 252/68 |
| 6,335,311 B1 | * | 1/2002 | Namiki et al. | 508/579 |
| 6,548,457 B1 | * | 4/2003 | Kaimai et al. | 508/280 |

FOREIGN PATENT DOCUMENTS

| | | |
|---|---|---|
| DE | 4431271 A1 | 3/1996 |
| EP | 0861883 A2 | 9/1998 |
| EP | 0989180 A1 | 3/2000 |
| EP | 1028156 A1 | 8/2000 |
| WO | WO 00/05329 | 2/2000 |

OTHER PUBLICATIONS

PCT Search Report for International Publication No. WO 01/68791, foreign counterpart to U.S. priority application No. 60/189,906.

European Equivalent of WO 00/05329 published Feb. 3, 2000.

Abstract of WO 00/05329, Lubricant for Refrigerating Machine with the Use of Ammonia Refrigerant (www.Ner-ac.com), Oct. 9, 2002.

* cited by examiner

*Primary Examiner*—Jacqueline V. Howard
(74) *Attorney, Agent, or Firm*—Samuel B. Laferty; Michael F. Esposito

(57) ABSTRACT

A problem with refrigeration systems using ammonia as the refrigerant and hydrocarbon lubricants is that the seals/gaskets of the systems have a tendency to harden and shrink. This can cause leakage of the refrigerant and eventually require disassembly of the equipment and replacement of the seals. The addition of a small amount polyether having an aromatic fragment of 6–18 carbon atoms or an aliphatic fragment of 10–22 carbon atoms can soften the seals and partially re-swell the seals solving the leakage problem and avoiding expensive maintenance costs. Alternatively a polyether of 1,2-butylene oxide which is more oil soluble than most other polyethers with a smaller Z group e.g. derived from alkanols of 1 to 9 carbon would be effective at reducing hardening and shrinkage.

20 Claims, No Drawings

LUBRICANT COMPOSITION FOR AMMONIA BASED REFRIGERANTS WITH GOOD SEAL PERFORMANCE

FIELD OF INVENTION

The present invention relates to fluid compositions for compression refrigeration systems such as heat pumps, refrigerating compressors, and air conditioning compressors. The refrigerant described for these systems is an ammonia based refrigerant. The lubricants are based on a hydrocarbon lubricant such as mineral oil, hydrogenated mineral oil or polyalphaolefin.

BACKGROUND OF INVENTION

Ammonia has long served as a refrigerant and continues to be an important refrigerant. Ammonia has been found to have no effect on the depletion of the ozone layer and, equally as important, ammonia does not contribute to the greenhouse effect. Ammonia has many attractive advantages such as being a highly efficient refrigerant at a relatively low cost. It also has a distinctive and easily detected odor and therefore any leaks can be quickly identified before large losses of refrigerant have occurred. The major disadvantages of using ammonia as a refrigerant are its toxicity and to a certain extent, its flammability above certain concentrations.

U.S. Pat. No. 5,595,678 to Glenn D. Short et al. teaches the use of polyalkylene glycol of the formula $Z\text{-}[(CH_2—CH(R^1)—O)_n—(CH_2—CH(R^1)—O—)_m]_p—H$ as the lubricant in various fluid compositions for refrigeration including ammonia, chlorofluorocarbon, hydrochlorofluorocarbon and hydrofluorocarbon refrigerants. This lubricant had benefits over mineral oil lubricants in its solubility in ammonia and benefits over more conventional polyether polyols that lacked the Z group described by Short. The more conventional polyethers suffered from low thermal stability without additives.

SUMMARY OF THE INVENTION

The use of a polyether with an alkyl aromatic fragment in a refrigeration fluid having a paraffinic lubricant within an ammonia environment controls elastomer seal swell and conditions the elastomeric seals to maintain their approximate volume and modulus. This prevents the hardening and/or shrinkage of the seals (elastomers). Paraffinic lubricants have many desirable properties in relation to mineral oil lubricants high in unsaturated hydrocarbon content for ammonia environments (including improved inertness to chemical reactions and thermal degradation). A shortcoming of paraffinic lubricants low in unsaturated hydrocarbon content is their adverse effect on seal volume and hardness. For the purposes of this specification, unsaturated hydrocarbon content will refer to aromatic components, cyclic olefins and acyclic olefins. Lubricants having high concentrations of aryl and alkaryl groups such as benzene and naphthalene have been used with ammonia environments due to their good compatibility with seals (retaining modulus and volume of seals after continuous use). The combination of paraffinic lubricants with a small amount of a polyether with an alkyl aromatic fragment offers better resistance to chemical and thermal degradation than mineral oils with high aromatic content.

The most significant drawback to converting from a lubricant high in aryl and alkaryl content to paraffinic lubricants low in aryl and alkaryl content for ammonia environments has been the non-quantifiable potential for seal failure. The problem in quantifying the potential is due to the wide variety of elastomers and elastomer blends used in the different seals in an ammonia refrigeration system. Some of these seals are more tolerant of hardening and shrinkage and don't leak after the substitution. Some seals fail immediately after substitution while others fail several months after the substitution of a different lubricant.

DETAILED DESCRIPTION OF INVENTION

It would be desirable to have an additive for ammonia based refrigeration fluids that could increase the seal swell and reduce seal hardening in the presence of a hydrocarbon lubricant. Seal shrinkage and seal hardening are often seen when converting an ammonia system from a mineral oil lubricant high in benzene and naphthalene (aryl and alkaryl) content to a mineral oil, hydrotreated mineral oil, or polyalphaolefin oil low in aryl and alkaryl content.

Ammonia refrigerants are well known commercially. It is a very energy efficient refrigerant and even though ammonia is hazardous when present in high concentrations, it is considered rather benign at low concentrations due to its occurrence in normal biological processes. It is also commercially available at reasonable prices and has little long term disposal or contamination problems. Ammonia refrigerant will generally refer to refrigerants that are at least 90 weight percent ammonia based on fluids that are active refrigerant and excluding contaminants and additives that have little or no refrigerant effect under the operating conditions. The refrigerant also does not include the lubricant although the working fluid would include both the refrigerant and the lubricant, to the extent both are present in any portion of the refrigeration system.

The lubricant refers to an oil that provides lubrication to the moving parts of the refrigeration system and may include additives that are dissolved in the oil such as wear reduction agents (antiwear additives), antioxidants, etc. Desirably the lubricant will be an aliphatic or cycloaliphatic oil with less than 10, more desirably less than 5 and preferably less than 1 weight percent of aryl and alkaryl molecules. Aryl and alkaryl molecules will be defined to be compounds having one or more aromatic rings, either as individual rings or as fused rings such as benzene, substituted benzenes, naphthalene, substituted naphthalenes, anthracene etc. Desirably these lubricants would have less than 10, more desirably less than 5 mole percent, and preferably less than 1 mole percent of compounds with unsaturated carbon to carbon double bonds, i.e. they would be relatively free of unsaturation They can specifically include mineral oils with less than the specified amounts of aryl and alkaryl compounds, hydrotreated mineral oils with less than the specified amounts of aryl and alkaryls, hydrocracked mineral oils, and polyalphaolefins. Desirably these aliphatic or cycloaliphatic lubricants would have viscosities at 40° C. of from about 5 or 20 to about 200 cSt and preferably from about 5 or 20 to about 100 or 150 cSt. These aliphatic oils have better thermal and chemical stability than oils having higher concentrations of unsaturation and/or aryl groups.

The term polyalphaolefins (PAO) is used to define the polymers derived from polymerizing alpha olefin monomers and these polymers are conventionally used as lubricants and lubricant additives. The polyalphaolefin has similar saturated chains with good thermal stability to the aliphatic mineral oils low in unsaturation. These polyolefins are polymers from olefins having unsaturation between their alpha and beta carbon atoms before the polymerization reaction. The polymerization and any subsequent treatments (hydrogenation) convert the unsaturated carbons to saturated carbons. The use of enough olefins of sufficient length and the polymerization process provides many alkyl branches of 2 to 20 carbon atoms that prevent crystallization of the polyolefins when used as lubricants. Polyalphaolefin is not used in this application to describe polymeric polyolefins that are solids at room temperature and are used as plastics.

Another class of substantially aliphatic oils is the hydrotreated or hydrocracked oils where a hydrogenation procedure has been used to eliminate the majority of unsaturation. In the case of hydrocracked oils, hydrogenation is used to reduce the number average molecular weight of the oils along with converting any unsaturation to saturated carbon to carbon bonds. These oils can be identified by the low unsaturation content. In the case of hydrotreated oils, the oil is treated by a hydrogenation process to remove aliphatic and optionally aromatic unsaturation. Hydrotreated and hydrocracked are two forms of hydrogenation.

The mineral oils high in benzene and naphthalene (aryl and alkaryl) content generally have poor thermal and chemical resistance and therefore tend to break down into lower molecular weight products and crosslink into sludge. The low molecular weight breakdown products form thinner films, don't have the lubricity of the original lubricant and travel more easily throughout the refrigeration cycle. The sludge settles out on surfaces in the refrigeration unit and can plug conduits. If the sludge deposits on a surface where heat transfer is occurring it reduces thermal transfer efficiency of the refrigeration system lowering efficiency. The aromatic nature of the benzene and naphthalene rings is believed to be the major reason for the lack of thermal and chemical resistance. While most parts of the refrigeration system involve low temperature uses, there are some areas in the compression side of the systems where the lubricant is exposed to higher temperatures and these areas are considered to be the primary sources of heat that initiate the thermal and chemical degradation of oils having high aromatic content.

Most of the volume of the mineral oil lubricants does not travel with the ammonia through the refrigeration system but rather remains in and near the compressor where it lubricates the moving mechanical parts. Mineral oils (high and low aromatic content) have low solubility in ammonia and therefore separate out from the ammonia at any opportunity. This may cause the lubricant to build up in parts of the systems such as intercoolers, suction accumulators, and evaporators. Unless this oil is replaced or returned to the compressors a deficiency of oil may occur in the compressor. In the evaporators the oil can separate and foul or build up on the surfaces of the heat exchangers lower the system efficiency as previously set forth.

Flooded evaporators include shell and tube types and flooded coil evaporators. In these flooded evaporators, all of the heat transfer surfaces are wetted by the liquid refrigerant. In these types of systems any oil that is traveling with the ammonia may phase separate out and coat the heat transfer surfaces. The presence of a polyether component that can help solubilize the aliphatic oils in the ammonia and thereby clean the surfaces and/or transport the aliphatic oil back to the compressors.

Welded plate and hybrid cross-flow plate evaporators have been proposed for use with ammonia based refrigerants. They would reduce the required refrigerant volumes to allow for the achievement of efficient heat transfer while also reducing the potential hazard for ammonia refrigerant leakage by decreasing the potential size of a discharge or leak. The reduction in refrigerant charge volumes enables ammonia to be safely permitted for use in a much wider variety of applications in addition to its common industrial applications. Another advantage of reduced refrigerant volumes is the smaller size of the system reduces the total cost.

Polyether is the common name for the homopolymers of cyclic alkylene oxides such as ethylene oxide or propylene oxide or for the copolymers of ethylene oxide, propylene oxide and other alkylene oxides. Polyethers have long been known as being soluble with ammonia and have been marketed for use in ammonia refrigeration applications. Because polyethers are polar in nature and, therefore, water soluble, they are not very soluble in non-polar media such as hydrocarbons. The insolubility of polyethers in non-polar media make them excellent compressor lubricants for non-polar gasses such as ethylene, natural gas, land fill gas, helium, or nitrogen. Because of this polar nature, polyethers have the potential for further becoming highly suitable lubricants for use with ammonia refrigerants. However the same polar nature which allows polyethers to be soluble in ammonia allows polyethers to be soluble in water and insoluble in mineral oils and PAO. Solubility with water has been a long-standing concern in ammonia refrigeration applications. The presence of excessive water can result in corrosion of the refrigeration system. The high specific volume of water as a vapor in refrigeration systems results a potential for water to displace a significant volume of the refrigerant within the system. This results in a need for larger equipment to compensate for the added water. Conversely if water is allowed to accumulate in excessive amounts, equipment designed for ammonia refrigeration would eventually become undersized due to the displacement of the refrigerant by the excess water volume.

Mutual solubility of the polyether and ammonia can cause other problems. The viscosity of the oil/refrigerant mixture is important at the operating conditions i.e. temperature and pressure of the compressor. It may be necessary to use a higher viscosity grade of polyether to provide the desired operating viscosity under diluted conditions for adequate fluid flow. Polyethers are desirably present at concentrations from about 1 to about 20 weight percent, based on the weight of the hydrocarbon lubricant, more desirably from about 1 to about 15 weight percent and preferably from about 1 to about 10 weight percent. These ethers are optionally the reaction product of a ring opening polymerization of one or more cyclic alkylene oxides of 2 to 5 carbon atoms with a compound of the formula Z, wherein Z has from 1 to 8 active hydrogens and a minimum of 6 carbon atoms when Z is an aryl or substituted aryl and a minimum of 10 carbon atoms when Z is aliphatic rather than aryl. The polyethers may be represented by the formula $$Z\text{-}[(CH(R^a)\text{—}CH(R^b)\text{—}O)_x]_p\text{—}H \qquad \text{Formula 1 or}$$

$$Z\text{-}[(CH_2\text{—}CH(R^1)\text{—}O)_n\text{—}(CH_2\text{—}CH(R^1)\text{—}O\text{—})_m]_p\text{—}H \qquad \text{Formula 2}$$

wherein Z is a residue of a compound having 1–8 active hydrogens. When $R^1$, $R^a$ and $R^b$ are H or methyl desirably the minimum number of carbon atoms is six (6) when Z includes an aryl group and a minimum number of carbon atoms is ten (10) when Z is an alkyl group, further wherein Z is more desirably an aryl or substituted aryl based compound of 6 to 18 carbon atoms or an aliphatic of 10 to 22 carbon atoms. It is to be understood that when Z is derived from an alcohol it includes one or more oxygen atoms which serve as points of attachment for the polyether to the Z fragment. When $R^1$, $R^a$ or $R^b$ are ethyl on a sufficient number of repeat units that the amount repeating units derived from polymerizing 1,2-butylene oxide in the polyether is at least 50 weight percent of the total repeating units, then Z can be the above described compounds or an alkyl of 1 to 9 carbon atoms. The range of Z candidates is increased due to a shielding effect of the ethyl substituent making the polyether much more oil soluble. When the polyether portion of the molecule is more oil soluble then a less hydrophobic Z group can be selected. Desirably Z is derived from an alcohol with from 1 to 8 active hydrogens, more desirably derived from an alcohol with 1 to 3 active hydrogens, said alcohols including benzyl alcohol, octyl phenol, nonyl phenol, di-nonyl phenol or a $C_{11}$ aliphatic alcohol. The term derived from an alcohol will include where the fragment Z is the specified alcohol less the hydrogen(s) of the hydroxyl group(s) as would occur in a polymerization of cyclic alkylene oxides using as an initiator such an alcohol.

$R^a$ and $R^b$ in Formula 1 are individually on each repeating unit a H, $CH_3$, or $CH_2$—$CH_3$ such that the repeating units comprise the polymerization products (including random copolymers and block copolymers) of cyclic alkylene oxides of 2 to 5 or 6 carbon atoms such as ethylene oxide, propylene oxide and butylene oxide and wherein $R^a$ is often H and $R^b$ is often —$CH_3$ alone (polypropylene oxide homopolymer) or wherein $R^b$ varies among —$CH_3$, H, and —$CH_2$—$CH_3$ on consecutive repeating units (e.g. a polypropylene copolymer with ethylene oxide or butylene oxide or both). The variable x is an integer from 1 to 50 and more desirably from 3 or 4 to 30 or 40. The variable $R^1$ is hydrogen, methyl, ethyl, or a mixture thereof, the variable n is 0 or a positive integer less than 50, the variable m is a positive integer less than 50, the variable m+n is a positive integer less than 50, and p is an integer having a value equal to the number of active hydrogens on Z. Desirably Z is from about 8 to about 55 weight percent of the polyether, more desirably from about 8 to about 30 weight percent of the polyether.

EXAMPLES

The following examples illustrate the effect of polyethers such as nonyl phenol propoxylate on elastomeric seals used in ammonia refrigerant systems using ammonia as the refrigerant and hydrocarbons as the lubricant. The samples were submerged in oil lubricant within an ammonia environment for 168 hours at 100° C. at a pressure of 100 psi. The elastomer used in the experiment is a commercial o-ring from Parker Corporation based on a cross-linked neoprene compound.

In Table 1 the o-ring was exposed to the ammonia and lubricant for the 168 hours and then the hardness of the ring and its volume was measured. PAO 10 is a polyalphaolefin of a viscosity close to 10 cSt at 100° C. A similar PAO is available from BP Amoco under the tradename Durasyn 170. EXP-1847 is a hydrotreated mineral oil that is generally equivalent to a highly paraffinic mineral oil base stock with an ISO viscosity of 68. PAG 200 is a nonyl phenol propoxylate having a viscosity of 100 cSt at 40° C. and having about 9 to 11 propylene oxide repeating units. The data in Table 1 show that PAO 10 and EXP-1847 harden and shrink the neoprene under the test conditions. The addition of PAG200 to PAO 10 or EXP-1847 alleviates both the hardening and shrinkage.

TABLE 1

| Example | Lubricant | Hardness Change | Volume Change (%) |
|---|---|---|---|
| 1 | PAO 10 | +13 | −14 |
| 2 | PAO 10 + 5 wt % PAG 200 | +5 | −8 |
| 3 | PAO 10 + 10 wt % PAG 200 | −1 | 0 |
| 4 | EXP-1847 | +9 | −9 |
| 5 | EXP-1847 + 5 wt % PAG 200 | −1 | −2 |
| 6 | EXP-1847 + 10 wt % PAG 200 | −4 | +1 |

In Table 2 an attempt was made to illustrate the beneficial effect of a polyether (PAG 200) on a neoprene seal or gasket as previously described that has already been exposed to a hydrocarbon lubricant. In the first sequence of the test, a neoprene o-ring was first exposed to a hydrocarbon lubricant (solvent-refined mineral oil in Examples 7–12) for 168 hours in the presence of ammonia. Hardness and volume change were measured after completion of the first sequence. Then in the second sequence the same neoprene gasket was exposed to PAO10, EXP-1847, PAO 10+PAG 200, and EXP-1847+PAG 200. Hardness and volume change were measured and recorded after completion of the second sequence. The hardness of the new o-ring, o-ring after the first sequence and second sequence of tests, and volume change after the first and second sequence of the tests compared to that of the original are presented in Table 2. The data in Table 2 illustrates that the use of PAO 10 or EXP-1847 after treatment with the hydrocarbon lubricant hardened the o-ring and caused shrinkage. The use of PAO 10 or EXP-1847 in combination with the polyether caused less hardening and less shrinkage than the use of PAO 10 or EXP-1847 alone. Thus the polyether can alleviate some of the hardening and shrinkage. In example 13 hydrotreated EXP-1847 was used in the first sequence instead of a solvent refined mineral oil. This resulted in less hardening and a slight increase in the seal volume.

TABLE 2

| Example | Lubricant used in the second sequence | Average hardness of the new o-ring | Average hardness of the o-ring after the first sequence of the test | Average hardness of the o-ring after the second sequence of the test | Average volume change (%), after the first sequence compared to original | Average volume change (%), after the second sequence compared to original |
|---|---|---|---|---|---|---|
| 7 | PAO 10 | 62 | 49 | 75 | +26% | −15% |
| 8 | PAO 10 + 5% PAG 200 | 62 | 49 | 58 | +26% | +1% |
| 9 | PAO + 10% PAG 200 | 62 | 49 | 64 | +26% | −2% |

TABLE 2-continued

| Example | Lubricant used in the second sequence | Average hardness of the new o-ring | Average hardness of the o-ring after the first sequence of the test | Average hardness of the o-ring after the second sequence of the test | Average volume change (%), after the first sequence compared to original | Average volume change (%), after the second sequence compared to original |
|---|---|---|---|---|---|---|
| 10 | EXP-1847 | 62 | 49 | 57 | +26% | +7% |
| 11 | EXP-1847 + 5% PAG 200 | 62 | 49 | 56 | +26% | +8% |
| 12 | EXP-1847 + 10% PAG 200 | 62 | 49 | 56 | +26% | +8% |
| 13 | EXP-1847 + 10% PAG 200 | 62 | 71 | 62 | −9% | +6% |

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

What is claimed is:

1. In a fluid composition for use in compression refrigeration including an ammonia refrigerant and a hydrocarbon lubricant, wherein the improvement comprises adding from about 1 to about 20 weight percent, based on the weight of the hydrocarbon lubricant, of a polyether being the reaction product of a ring opening polymerization of an alkylene oxide of 2 to 5 carbon atoms from a compound Z having from 1 to 8 active hydrogens, wherein Z has a minimum of 6 carbon atoms when Z includes an aryl and a minimum of 10 carbon atoms when Z is aliphatic unless the polyether has at least 50 weight percent repeating units derived from polymerizing 1,2-butylene oxide, in which case Z can also be an aliphatic group of 1 to 9 carbon atoms.

2. In a fluid according to claim 1, wherein said hydrocarbon lubricant includes less than five weight percent of compounds having one or more carbon to carbon double bonds.

3. In a fluid according to claim 2, wherein said hydrocarbon lubricant comprises a mineral oil, a hydrotreated or hydrocracked mineral oil, or a polyalphaolefin.

4. In a fluid according to claim 1, wherein Z has from 6 to 18 carbon atoms if it includes an aryl group and from about 10 to 22 carbon atoms if it is entirely aliphatic and the cyclic alkylene oxide is ethylene oxide, propylene oxide, or butylene oxide.

5. In a fluid according to claim 1, wherein the compound of the formula Z was an alcohol or the reaction product of an alcohol with a strong base (e.g. alkoxide).

6. In a fluid according to claim 1, wherein the compound of formula Z is benzyl alcohol, octyl phenol, nonyl phenol, di-nonyl phenol, or a C11 alcohol.

7. In a fluid according to claim 5, wherein Z is from about 8 to about 55 weight percent of said polyether.

8. In a fluid according to claim 1, wherein said polyether has a viscosity at 40° C. from about 15 to about 460 cSt.

9. In a fluid according to claim 2, wherein said polyether is characterized as a homopolymer of propylene oxide or a copolymer of propylene oxide with at least one other alkylene oxide.

10. In a fluid composition for use in compression refrigeration including an ammonia refrigerant and a hydrocarbon lubricant, wherein the improvement comprises adding from about 1 to about 20 weight percent, based on the weight of the hydrocarbon lubricant, of a polyether of the formula $$Z\text{-}[(CH(R^a)—CH(R^b)—O)_x]_p—H$$

wherein Z is a residue of a compound having 1–8 active hydrogens and a minimum number of carbon atoms of 6 when Z includes an aryl group and a minimum number of carbon atoms of ten (10) when Z is an alkyl group unless $R^a$ or $R^b$ are ethyl on a sufficient number of repeat units such that the amount of 1,2-butylene oxide based repeating units in the polyether is at least 50 weight percent of the total ether based repeating units, then Z can be the residue of the above described compounds or a residue of a compound having an alkyl of 1 to 9 carbon atoms, x is an integer from 1 to 50, $R^a$ and $R^b$ are individually on each repeating unit a H, $CH_3$, or $CH_2$—$CH_3$, p is an integer having a value equal to the number of active hydrogens on Z.

11. In a fluid according to claim 10, wherein said hydrocarbon lubricant includes less than five weight percent of compounds having one or more carbon to carbon double bonds.

12. In a fluid according to claim 11, wherein said hydrocarbon lubricant comprises a mineral oil, a hydrotreated or hydrocracked mineral oil, or a hydrogenated polyalphaolefin.

13. In a fluid according to claim 10, wherein Z has from 6 to 18 carbon atoms if it includes an aryl group and from about 10 to 22 carbon atoms if it is entirely aliphatic and the cyclic alkylene oxide is ethylene oxide, propylene oxide, or butylene oxide.

14. In a fluid according to claim 10, wherein the compound of the formula Z is an alcohol.

15. In a fluid according to claim 10, wherein the compound of formula Z is benzyl alcohol, octyl phenol, nonyl phenol, di-nonyl phenol, or a C11 alcohol.

16. In a fluid according to claim 14, wherein Z is from about 8 to about 55 weight percent of said polyether.

17. In a fluid according to claim 10, wherein said polyether has a viscosity at 40° C. of from about 15 to about 460 cSt.

18. In a fluid according to claim 10, wherein said polyether is characterized as a homopolymer of propylene oxide or copolymer of propylene oxide and another alkylene oxide.

19. In a fluid according to claim 1, wherein at least 50 weight percent of the polyether repeating units are 1,2-butylene oxide and Z is characterized as a residue of an aliphatic group of 1 to 9 carbon atoms.

20. In a fluid according to claim 10, wherein at least 50 weight percent of the polyether repeating units are 1,2-butylene oxide and Z is characterized as a residue of an aliphatic group of 1 to 9 carbon atoms.

* * * * *